US006683603B2

(12) United States Patent
Murai et al.

(10) Patent No.: US 6,683,603 B2
(45) Date of Patent: Jan. 27, 2004

(54) LIQUID CRYSTAL DISPLAY DEVICE

(75) Inventors: Hiroyuki Murai, Tokyo (JP); Hideto Ishiguro, Nagano (JP)

(73) Assignees: Mitsubishi Denki Kabushiki Kaisha, Tokyo (JP); Seiko Epson Corporation, Tokyo (JP)

( * ) Notice: Subject to any disclaimer, the term of this patent is extended or adjusted under 35 U.S.C. 154(b) by 112 days.

(21) Appl. No.: 09/727,784

(22) Filed: Dec. 4, 2000

(65) Prior Publication Data

US 2001/0003447 A1 Jun. 14, 2001

(30) Foreign Application Priority Data

Dec. 8, 1999 (JP) ..... 11-349012

(51) Int. Cl.[7] ..... G09G 5/00; G09G 3/36
(52) U.S. Cl. ..... 345/204; 345/93; 345/100
(58) Field of Search ..... 345/87, 89, 93, 345/100, 103, 204, 112; 455/446; 327/526

(56) References Cited

U.S. PATENT DOCUMENTS 5,136,282 A * 8/1992 Inaba et al. ..... 345/103
5,781,171 A * 7/1998 Kihara et al. ..... 327/526
5,877,740 A 3/1999 Hirakata et al.
6,225,969 B1 * 5/2001 Ishii ..... 345/100
6,232,939 B1 * 5/2001 Saito et al. ..... 345/100
6,353,435 B2 * 3/2002 Kudo et al. ..... 345/204

FOREIGN PATENT DOCUMENTS

JP 10307566 11/1998

* cited by examiner

*Primary Examiner*—Vijay Shankar
*Assistant Examiner*—Prabodh M. Dharia
(74) *Attorney, Agent, or Firm*—Leydig, Voit & Mayer, Ltd.

(57) ABSTRACT

A liquid crystal display device with point-sequential driving so that unevenness in brightness on a display screen becomes less noticeable. A signal line driving circuit that applies an image signal voltage sent from a signal processing circuit and a timing circuit to signal lines for point-sequential driving of the signal lines includes a driving direction switching circuit for inverting driving direction in the point-sequential driving, and the signal processing circuit includes an image signal rearranging circuit rearranging image signals in accordance with inversion of the driving direction, in synchronization with the inversion of the driving direction.

5 Claims, 11 Drawing Sheets

LIQUID CRYSTAL DISPLAY DEVICE

BACKGROUND OF THE INVENTION

1. Field of the Invention

The present invention relates to a liquid crystal display device, and more particularly to a liquid crystal display device with reduced unevenness in brightness of a liquid crystal display screen with point-sequential driving.

2. Description of the Background Art

Referring to FIG. 11, a signal processing circuit 122 receives an input of a digital image signal and performs signal processing on the signal for output to a signal line driving circuit 101 as an image signal. A timing circuit 121 that receives and sends signals to and from the signal processing circuit 122 receives an input of a synchronization signal of a signal line 105 and a scanning line 106 as well as a digital clock signal, and processes them for output to a scanning line driving circuit 102 as a scanning line signal and simultaneously outputs a synchronization signal to the signal line driving circuit 101. The signal line driving circuit 101 applies an image signal voltage via signal lines 105 to a liquid crystal display element (not illustrated) at intersections with a scanning line 106 in an on-state by point-sequential driving. The on-state of the scanning line 106 moves sequentially from the top of the display screen in a downward direction. Typically, a display region 110 is divided into a plurality of blocks 111, and the signal lines 105 and the signal line driving circuit are also divided into blocks.

Referring to FIG. 12, the display region 110 as well as the signal lines are divided into four blocks 111. The scanning line driving circuit 102 applies a scanning signal voltage selectively to each scanning line to open and close a pixel switching element. The signal line driving circuit 101 applies an image signal voltage to a liquid crystal display element via a pixel switching element in an on-state for driving the liquid crystal display element. When point-sequential driving is carried out in a liquid crystal display device, a transient phenomenon with a time constant of RC occurs due to the resistance (R) and the capacitance (C) in each liquid crystal display element, whereby the signal voltage is not applied without change to the liquid crystal display element of each pixel. When the image signal voltage is applied to the liquid crystal display element by the signal line driving circuit 101, the voltage applied to the liquid crystal display element rises in a transient manner with the time constant RC due to the transient phenomenon. As a result, in the case of applying a voltage to one scanning line in each block 111 in point-sequential driving, the actual voltage of the liquid crystal display element of the pixel to which the voltage has been applied first is higher than the voltage of the liquid crystal display element of the pixel to which the voltage has been applied last. Regarding the voltages of the liquid crystal display elements, the voltage at the end of the point-sequential driving of one scanning line in a block is frozen as it is, so that unevenness of brightness such as shown in FIG. 12 occurs. Referring to FIG. 12, the direction 115 of point-sequential driving in each block 111 of the display region 110 is the same. Therefore, a strong unevenness of brightness occurs at a boundary of the blocks 111 on the display screen.

In order to prevent a strong unevenness of brightness occurring at the boundary of blocks, a proposal has been made in which the driving direction 115 of point-sequential driving of each block is made opposite to the driving direction 115 of the adjacent blocks, as shown in FIG. 13 (Y. Aoki et al., A 10.4-in. XGA Low-Temperature Poly-Si TFT-LCD for Mobile PC Applications, SID 99 DIGEST, pp. 176–179). By this point-sequential driving method, the strong unevenness at the boundary of blocks is eliminated.

However, although the unevenness of brightness at the boundary of blocks is eliminated by the aforementioned point-sequential driving method, the unevenness of brightness within each block still remains without being eliminated. If a portion having a brightness lower by 3% or a portion having a brightness higher by 3% than the brightness of the screen is present, the presence of unevenness in brightness is recognized by a human eye. Therefore, the unevenness of brightness caused by the same voltage difference is recognized more keenly on a dark screen than on a bright screen. If such an unevenness of brightness is conspicuous, the display quality is deteriorated to a considerable extent, so that an improvement must be made in order to prevent the unevenness of brightness from being conspicuous.

SUMMARY OF THE INVENTION

An object of the present invention is to provide a liquid crystal display device that performs point-sequential driving so that the unevenness of brightness on the display screen will not be recognized to be conspicuous.

A liquid crystal display device according to the first aspect of the present invention includes a plurality of scanning lines and a plurality of signal lines that make an intersection with each other in a display region divided into a plurality of blocks by a boundary parallel to the signal lines; liquid crystal display elements disposed at sites of the intersection; a signal line driving circuit that applies an image signal voltage sent from a signal processing circuit and a timing circuit to the signal lines divided into a plurality of blocks for performing point-sequential driving of the signal lines; and a scanning line driving circuit that applies a scanning signal voltage sent from the timing circuit to the plurality of scanning lines for driving the scanning lines, the signal line driving circuit and the scanning line driving circuit being disposed in a driving circuit region, wherein the above-mentioned signal line driving circuit includes a driving direction switching circuit for inverting a driving direction of the point-sequential driving in the blocks according to a signal from the signal processing circuit, and the above-mentioned signal processing circuit includes an image signal rearranging circuit for performing rearrangement of image signals, which is needed in accordance with inversion of the driving direction, in synchronization with the inversion of the driving direction.

By this construction, the pattern of unevenness in brightness in the display region can be made uniform by changing the arrangement of unevenness in brightness with lapse of time in each block. As a result, it is possible to reduce the extent of recognized unevenness in brightness not only at the boundary of the blocks but also within the blocks.

In the liquid crystal display device according to the first aspect of the present invention, the timing circuit includes a driving direction switching timing output circuit for outputting a switching timing of the driving direction to the signal line driving circuit.

By this construction, the driving direction switching circuit can perform inversion of the driving direction of the point-sequential driving, for example, for each frame or for each line. Here, one frame refers to the period of time for applying a scanning signal voltage to each scanning line from the top to the bottom of the screen while performing the point-sequential driving in each block until the point-sequential driving is finished, or the screen displayed at that time. In other words, one collective screen is displayed over the entire display region within the period of time for one frame. As a result, thickly displayed parts are replaced with thinly displayed parts for each frame, so that the unevenness is averaged in time, so that the unevenness of brightness is less noticeable.

Further, with the use of the timing circuit and the signal processing circuit, the device can be operated such that, for example, the direction of point-sequential driving is alternated line by line in a block, and the driving direction of each line is inverted for each frame. According to the above-mentioned construction, the unevenness in brightness is disposed in alternate arrangement for each scanning line in the block, so that the unevenness is intermixed in fine spatial units. As a result, the unevenness in brightness is not recognized to be conspicuous, and the displayed image is recognized to be uniform by a human eye. Furthermore, in the case of alternately inverting the polarity of the applied voltage every time the driving direction is inverted for each scanning line, it is possible to avoid a situation in which the whole block is in a state of positive voltage or negative voltage. As a result, the flickering or the like can be prevented.

A liquid crystal display device according to the second aspect of the present invention includes a plurality of scanning lines and a plurality of signal lines that make an intersection with each other in a display region divided into a plurality of blocks by a boundary parallel to the signal lines; liquid crystal display elements disposed at sites of the intersection; a signal line driving circuit that applies an image signal voltage sent from a signal processing circuit and a timing circuit to the signal lines divided into a plurality of blocks for performing point-sequential driving of the signal lines; and a scanning line driving circuit that applies a scanning signal voltage sent from the timing circuit to the plurality of scanning lines for driving the scanning lines, the signal line driving circuit and the scanning line driving circuit being disposed in a driving circuit region, wherein the above-mentioned blocks include a plurality of first subblock groups and a plurality of second subblock groups which are alternately disposed, and the signal line driving circuit includes a first group driving circuit for applying the image signal voltage to the liquid crystal display elements of the first subblock groups for performing point-sequential driving, and a second group driving circuit for applying the image signal voltage to the liquid crystal display elements of the second subblock groups for performing point-sequential driving. At this time, as in the liquid crystal display device of another second aspect of the present invention, the signal processing circuit and the timing circuit are preferably constructed in such a manner that the driving directions in the first subblock groups and the second subblock groups are opposite to each other.

By this construction, each block is divided into smaller parts by a boundary in the signal line direction. For example, adjacent to a thickly displayed part of the first subblock group on the left end in a block, a thinly displayed part of the second subblock group is disposed. An opposite combination of unevenness in brightness is disposed on the right end in the block. Further, at the center of each block, parts displayed in an intermediate thickness of the first subblock group and the second subblock group are alternately disposed. As a result, it is possible to obtain a displayed image in which the unevenness in brightness is not conspicuous. However, in this case, unevenness in a longitudinal stripe pattern remains because the boundary in the signal line direction is present. The above has been explained for the first subblock groups and the second subblock groups. However, the same applies even if the third subblock groups, the fourth subblock groups, etc. are added.

In the liquid crystal display device according to the second aspect of the present invention, the first group driving circuit and the second group driving circuit include a first group driving direction switching circuit and a second group driving direction switching circuit, respectively, for inverting the driving direction in the first subblock groups and the second subblock groups, and the signal processing circuit includes an image signal rearranging circuit for performing rearrangement of image signals in each subblock group, which is needed in accordance with switching of the driving direction, in synchronization with the inversion of the driving direction.

By this construction, uniformization of the unevenness in brightness in time can be made in addition to the above-mentioned spatial uniformization of the unevenness in brightness by intermixing of the unevenness in brightness in minute units in the above-mentioned liquid crystal display device according to the second aspect of the present invention. As a result, the unevenness in brightness will be less noticeable, and the unevenness in brightness in a longitudinal stripe pattern will also be less noticeable.

In the liquid crystal display device according to the second aspect of the present invention, the timing circuit preferably includes a driving direction switching timing output circuit for outputting a switching timing of the driving direction to the signal line driving circuit.

By this construction, the device can be operated so that the driving direction is inverted for each frame or for each scanning line. As a result, the unevenness in brightness is made uniform in time while the unevenness in brightness is intermixed in a checker-board pattern spatially divided into very small parts. Therefore, the unevenness in brightness is hardly recognizable by a human eye, and it is possible to obtain a displayed image being extremely excellent in uniformity. Further, the flickers are hardly visible if the image signal voltage is inverted when the driving direction is inverted for each scanning line.

In the liquid crystal display device according to the first and second aspects of the present invention, in all the liquid crystal display devices having a driving direction switching circuit that inverts the driving direction, the driving direction switching circuit includes a polarity inversion circuit for inverting the polarity of the image signal voltage every time the inversion of the driving direction of the point-sequential driving is carried out.

By this construction, it is possible to prevent an image signal voltage of the same polarity from being applied over the entire block. As a result, flickers and others on the screen can be restrained.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4A shows the unevenness in brightness in the n-th frame, and FIG. 4B shows the unevenness in brightness in the (n+1)-th frame;

FIG. 5A shows the unevenness in brightness in the m-th frame, and FIG. 5B shows the unevenness in brightness in the (m+1)-th frame;

FIG. 9A shows the unevenness in brightness on the display screen in one frame, and FIG. 9B shows the unevenness in brightness on the display screen in the frame immediately after the frame of FIG. 9A;

FIG. 10A shows the unevenness in brightness in the m-th frame, and FIG. 10B shows the unevenness in brightness in the (m+1)-th frame;

DESCRIPTION OF THE PREFERRED EMBODIMENTS

Next, preferred embodiments of the present invention will be described with reference to the attached drawings.

Embodiment 1

Figure 1:
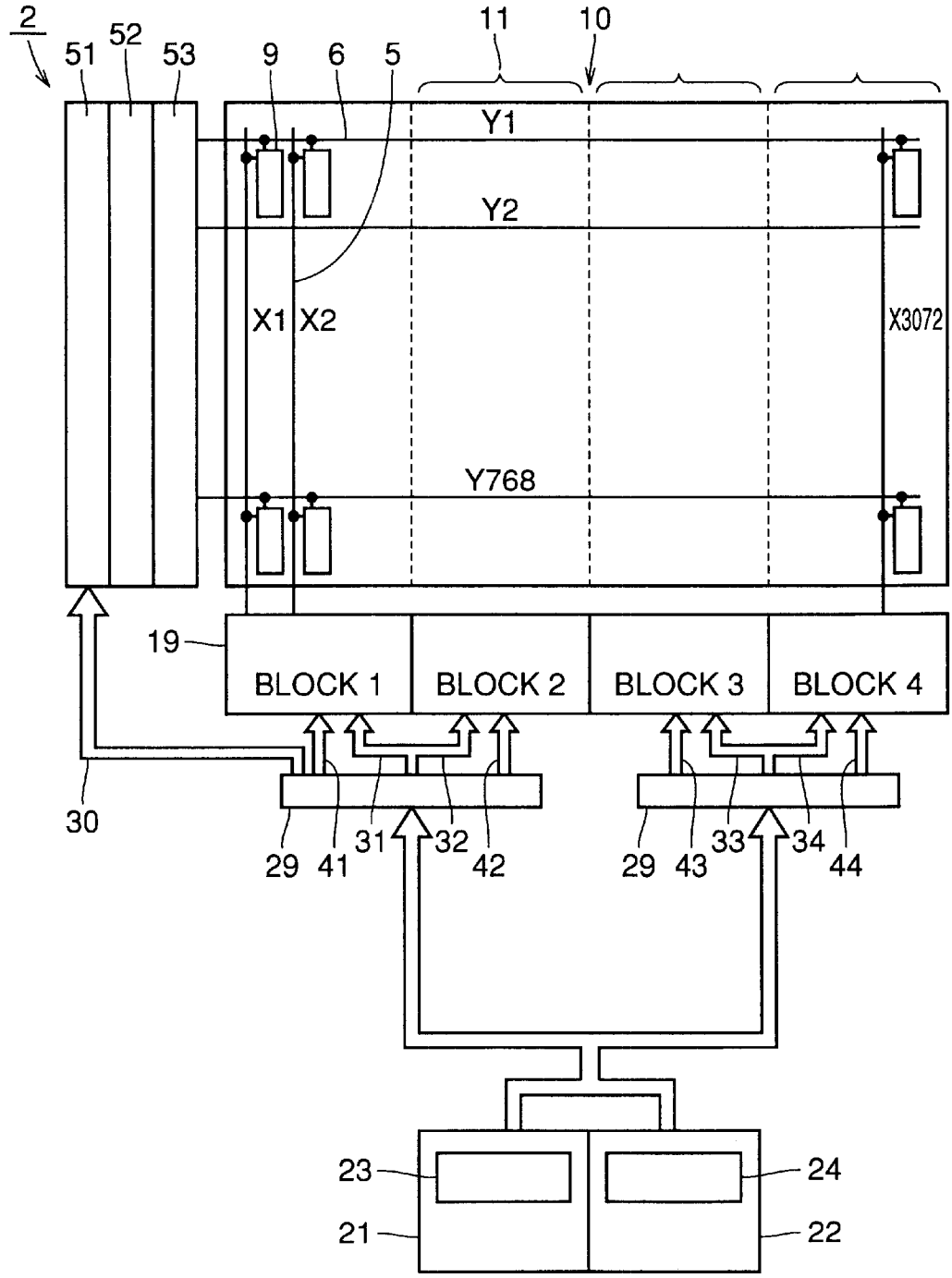
FIG. 1 is a diagram representing a partial construction of a liquid crystal display device according to Embodiment 1.

Referring to FIG. 1, signal lines 5 and scanning lines 6 are disposed to make an intersection with each other in a matrix configuration in a display region 10. At each intersection, a liquid crystal display element 9 is disposed which includes a pixel part switching element (not illustrated), a pixel electrode (not illustrated), and a liquid crystal. The display region 10 is divided into four blocks 11 together with the signal lines. A driving circuit includes a signal line driving circuit of an X-side driving circuit and a scanning line driving circuit of a Y-side driving circuit. The number of the signal line driving circuits 19 is equal to the number of the blocks so that each signal line driving circuit corresponds to each block. Image signals 31, 32, 33, 34 of each block are supplied to each signal line driving circuit 19 via an I/O interface 29. Further, driving control signals 41, 42, 43, 44 of each block are also supplied to each signal line block driving circuit 19 via the I/O interface 29. A scanning line driving control signal 30 that controls driving of the Y-side driving circuit is supplied to each scanning line 6 via a shift register 51, a level shifter 52, and a buffer 53. One signal line driving circuit is in charge of driving 768 signal lines. The number of signal lines that are driven can be changed in accordance with the grade of image quality. To the I/O interface 29, an image signal is supplied to the signal driving circuit and a driving synchronization signal is supplied to the scanning line driving circuit and the signal line driving circuit from a signal processing circuit 22 including an image signal rearrangement circuit 24 and from a timing circuit 21 including a driving direction switching timing output circuit 23, respectively.

Figure 2:
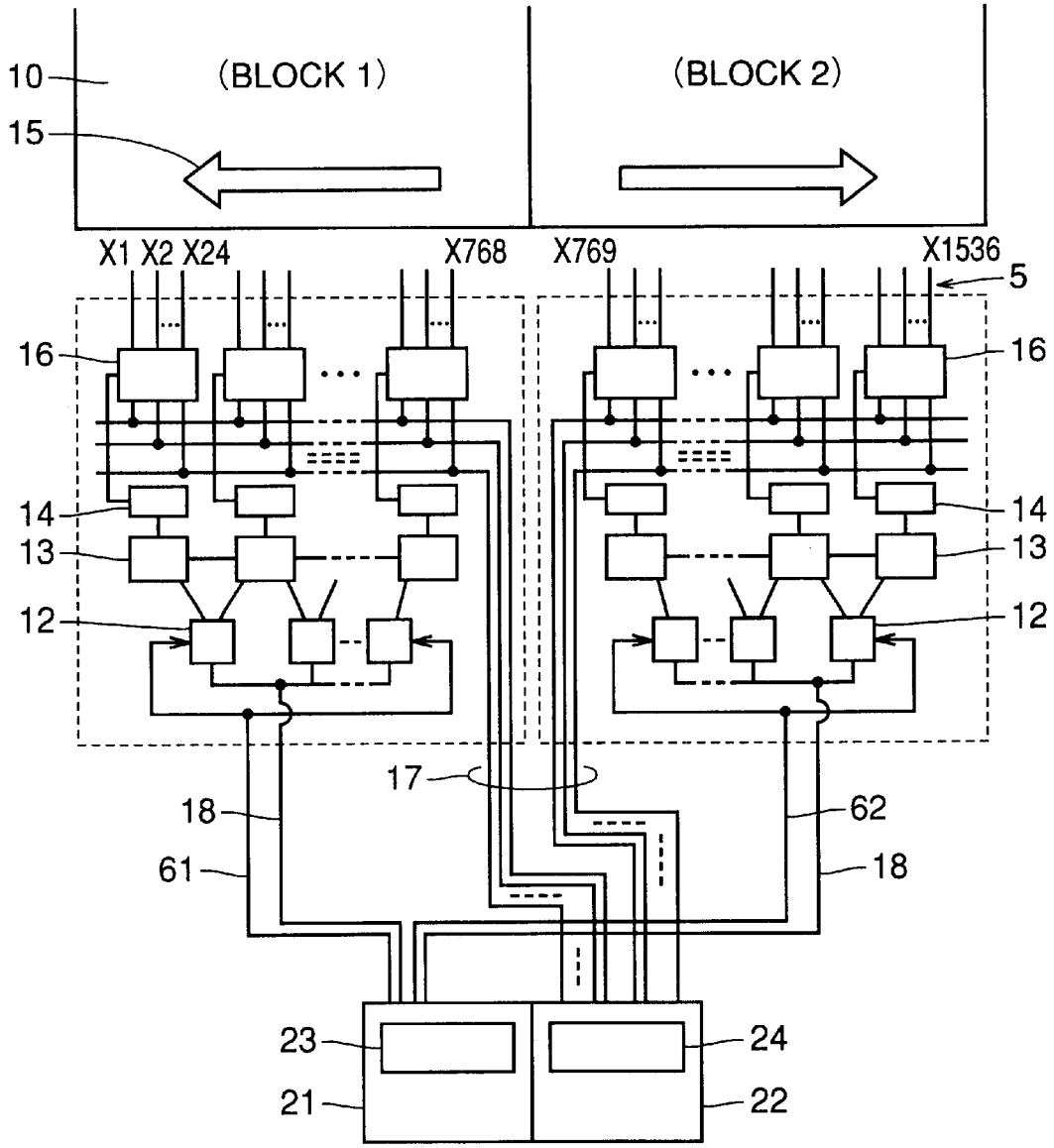
FIG. 2 is a schematic diagram representing a construction of a signal line driving circuit in the liquid crystal display device of FIG. 1.

Referring to FIG. 2, the block 1 and the block 2 are the same except for the driving direction 15, so that explanation will be given only on the block 1. A start signal is input via its input line 61, and a switching signal for switching the driving direction is input into a driving direction switching circuit 12 via its driving direction switching signal line 18. The start signal and the switching signal are both output from the timing circuit 21. These two signals are input into s shift register 13 via the driving direction switching circuit 12, and are further supplied via a buffer circuit 14 to an analog switch 16 made of an n-type transistor and a p-type transistor (not illustrated). These signals drive the signal lines in a predetermined direction. The image signals are input from an image signal input line 17 via the image signal rearrangement circuit to the analog switch 16, and an image signal voltage is applied from the analog switch 16 to the pixel electrodes in the display region. Each analog switch 16 supplies an image signal voltage to 24 signal lines. Since 32 analog switches 16 are disposed in each block, a sum of 768 signal lines 5 are contained in one block. As described above, the number of signal lines can be increased or decreased in accordance with the intended grade of image quality. Regarding the image signals, the rearrangement of image signals, which rearrangement is needed in accordance with the inversion of the driving direction, is already made in the image signal rearrangement circuit 24 included in the signal processing circuit 22 on the basis of a signal brought from the timing circuit 21. For this reason, even if the driving direction is inverted, a normal image is displayed because the image signals are rearranged in accordance therewith.

The timing circuit includes a driving direction switching timing output circuit 23 that determines the timing for switching the above-mentioned driving direction, and inverts the driving direction, for example, frame by frame.

Figure 3:
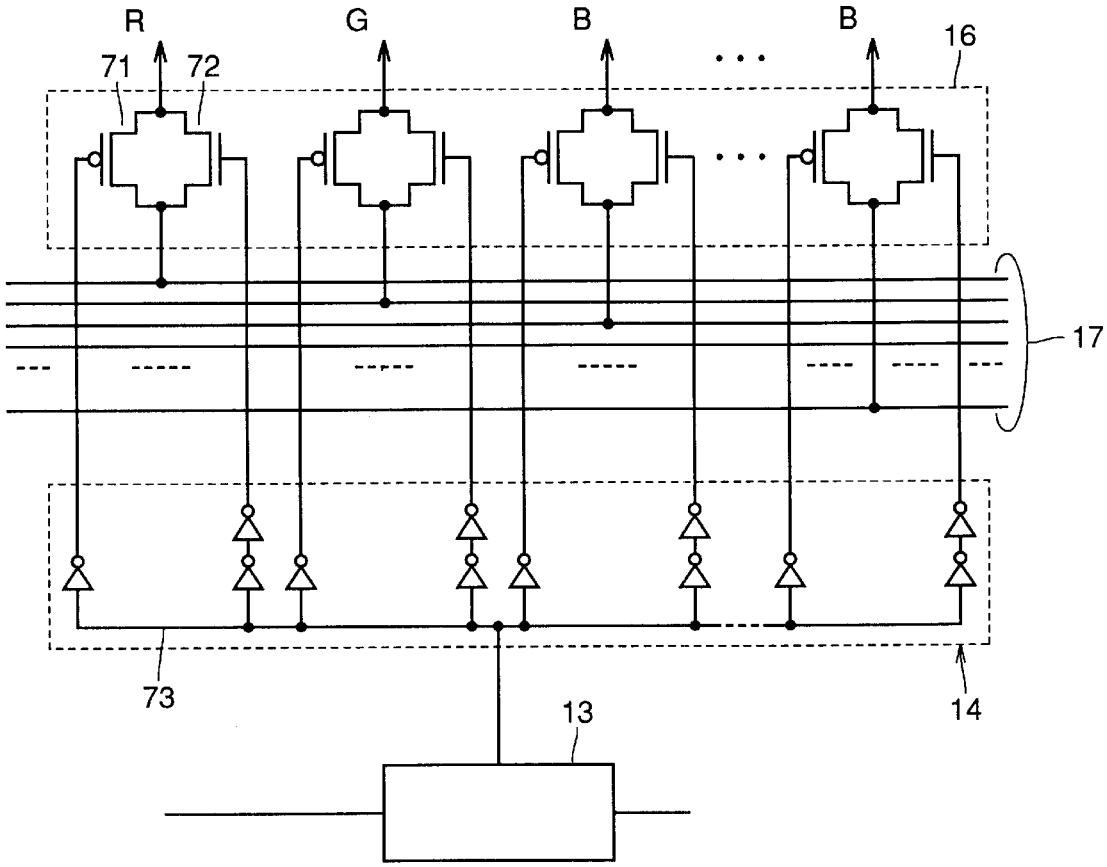
FIG. 3 is a schematic diagram representing a construction of an analog switch of FIG. 2.

Referring to FIG. 3, an analog switch control signal output from the shift register 13 is input into a buffer circuit 14 via an analog switch control signal line 73. The buffer circuit operates a p-type transistor and an n-type transistor 71, 72 in accordance with the switching of the driving direction to apply a positive voltage or a negative voltage to the signal lines. Such inversion of the polarity of the voltage is usually carried out in order to prevent abnormal operation of the liquid crystal that occurs when a voltage of one polarity is continuously applied to the liquid crystals.

Figure 4A:
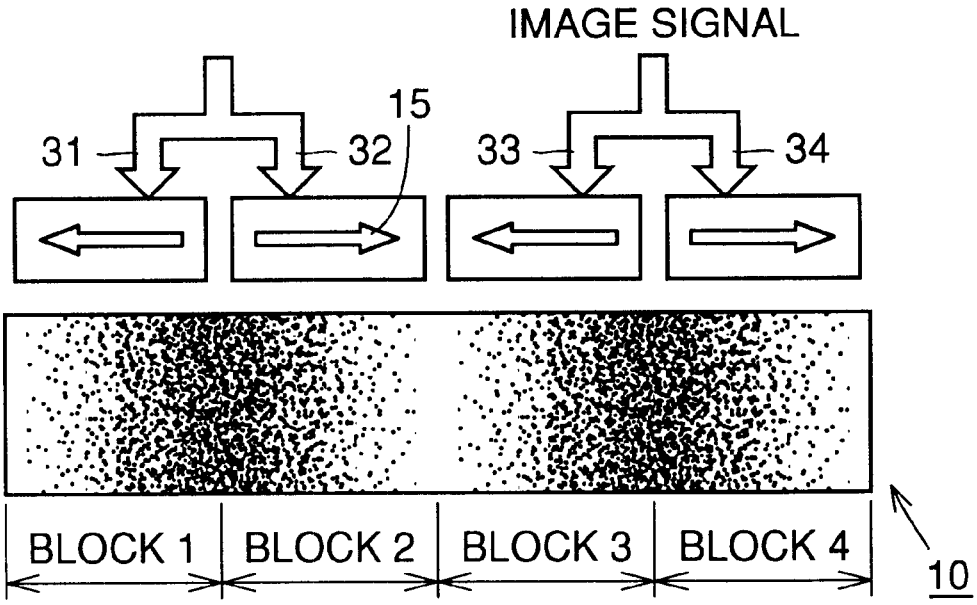
FIGS. 4A and 4B are illustrations showing unevenness in brightness on the display screen in Embodiment 1, where
Figure 4B:
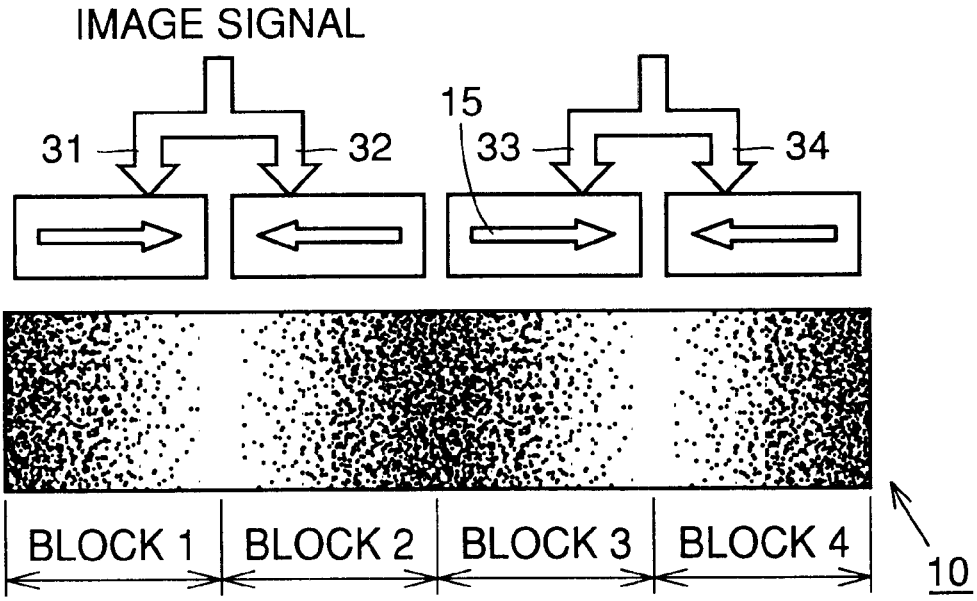

FIGS. 4A and 4B show the change of unevenness in brightness when the driving direction is inverted frame by frame using the above-mentioned liquid crystal display device. Since FIGS. 4A and 4B are repeated for each frame (for example, 16.6 ms), the unevenness in brightness is recognized by a human eye as being made uniform in time. As a result, conspicuous unevenness in brightness is eliminated, and it is possible to substantially prevent the deterioration of image quality.

Embodiment 2

Figure 5A:
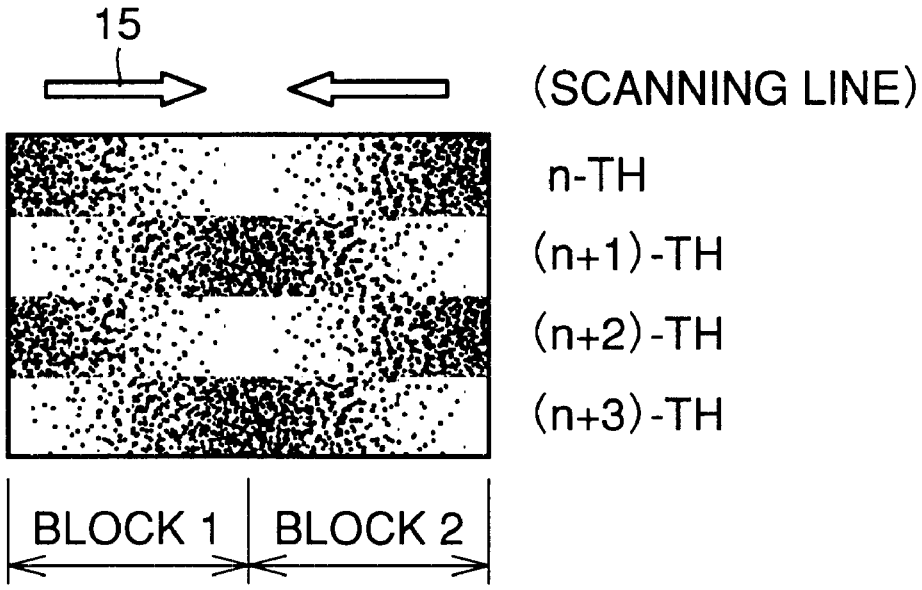
FIGS. 5A and 5B are illustrations showing unevenness in brightness on the display screen in Embodiment 2 in which the driving direction is switched for each scanning line, where
Figure 5B:
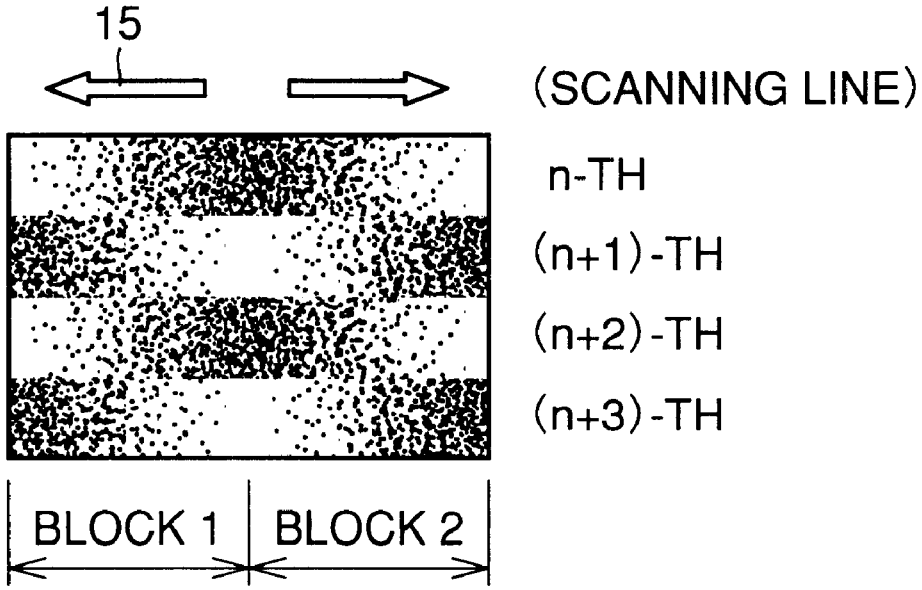

In the liquid crystal display device according to the preferred embodiment 2 of the present invention, the switching of the driving direction in the driving direction switching timing output circuit is inverted for each scanning line in the block with the use of the device construction in the embodiment 1. Referring to FIG. 5A, the unevenness in brightness is intermixed in minute spatial units (for each scanning line), so that the unevenness in brightness is less noticeable to a human eye. Further, if the driving direction is inverted frame by frame from the driving direction of the previous frame as shown in FIG. 5B, the unevenness in brightness is made uniform also in time, so that the unevenness in brightness is lessened and less noticeable. Further, both in FIGS. 5A and 5B, by inverting the polarity of the output voltage of the analog switch every time the driving direction is switched, it is possible to avoid a situation in which only the voltage of one polarity is applied to the whole screen. As a result, the flickering of the screen can be restrained. As a result, the display quality can further be improved. Here, one frame is, for example, 16.6 ms as described above, and the point-sequential driving time for one scanning line in the block is, for example, 20 $\mu$s.

Embodiment 3

Figure 6:
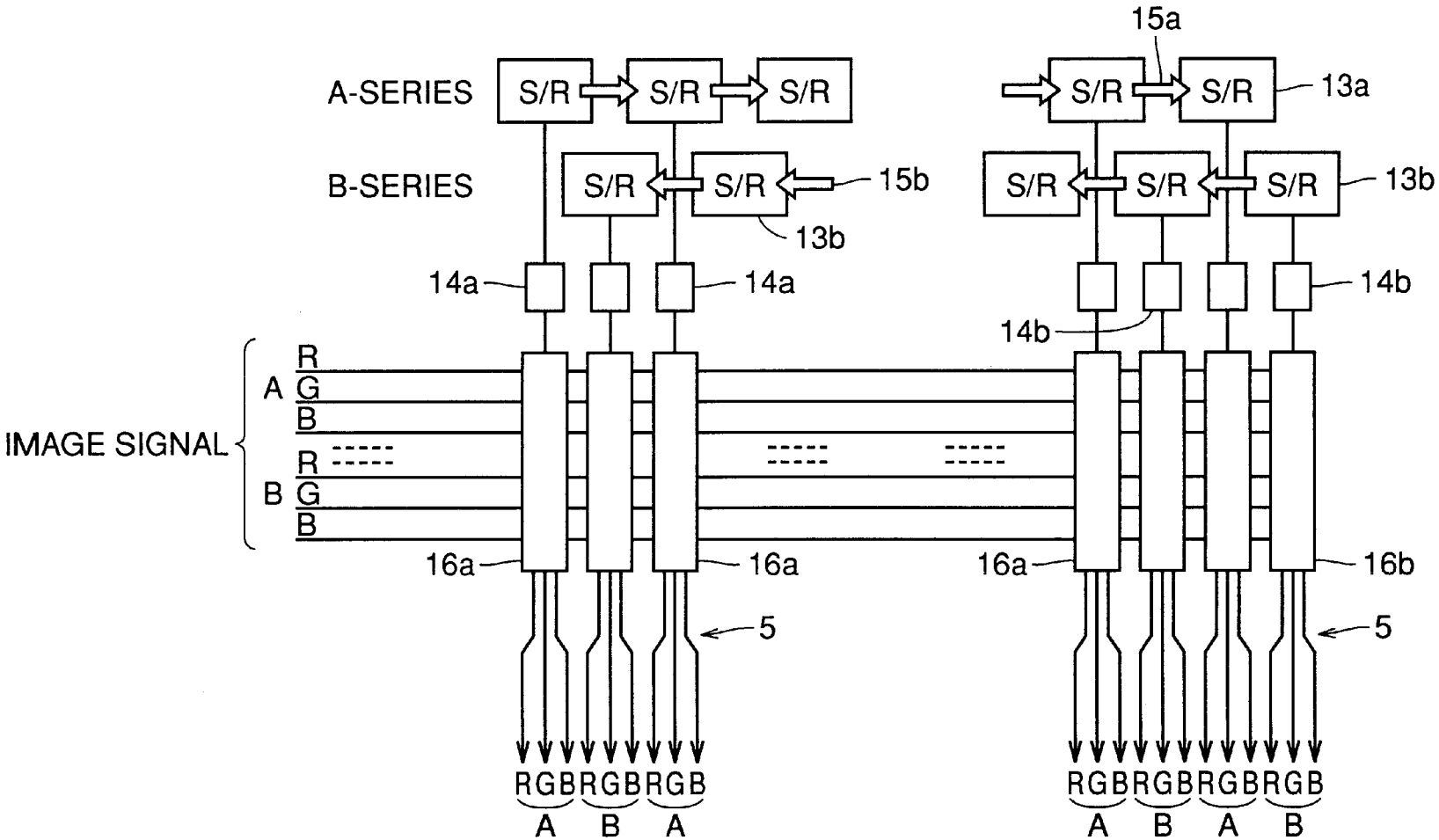
FIG. 6 is a diagram representing a partial construction of a signal line driving circuit in the liquid crystal display device according to Embodiment 3.
Figure 7:
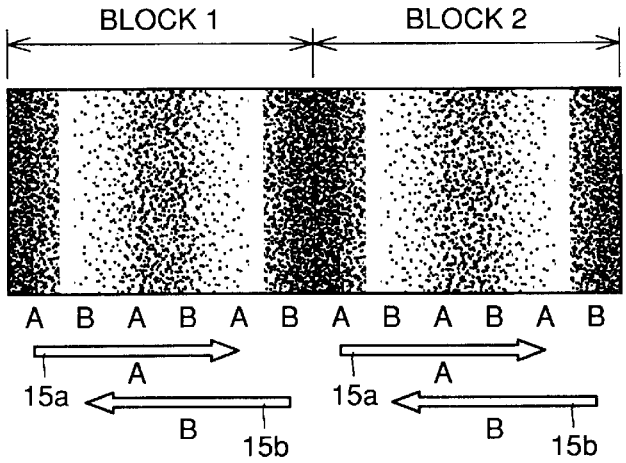
FIG. 7 is an illustration showing unevenness in brightness on the display screen in Embodiment 3.

Referring to FIG. 6, the blocks are divided into A-series and B-series, and each series is driven by a separate signal line driving circuit. At this time, the driving direction in the A-series is made opposite to the driving direction in the B-series. In FIG. 6, one analog switch 16*a* of the A-series is in charge of the three fundamental colors R, G, B of one pixel; however, one analog switch may be in charge of more pixels. Referring to FIG. 7, by separating the blocks into the A-series and the B-series to form an alternate arrangement, the unevenness in brightness is substantially divided into smaller parts spatially, so that the unevenness in brightness is less likely to be recognized by a human eye. However, in FIG. 7, longitudinal stripes of unevenness in brightness appears at the boundary of the A-series and the B-series which is parallel to the signal lines.

Embodiment 4

Figure 8:
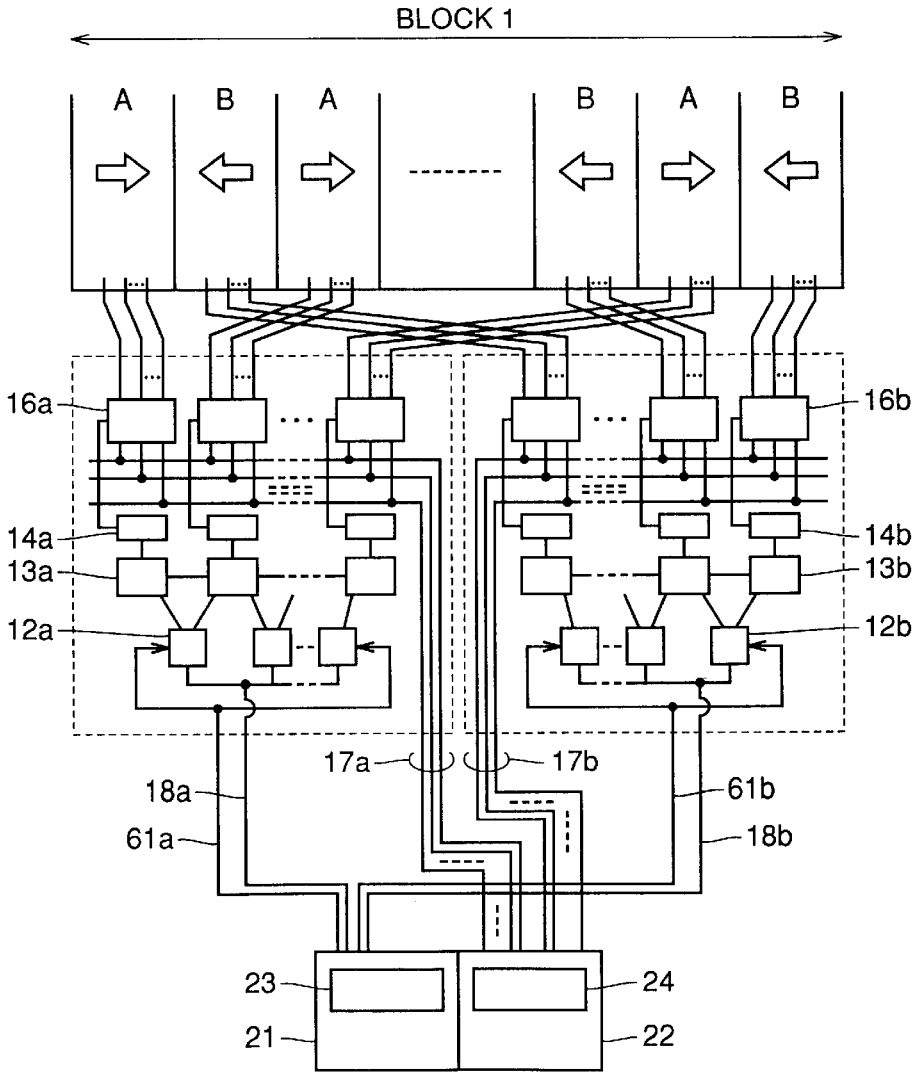
FIG. 8 is a diagram representing a partial construction of a signal line driving circuit in the liquid crystal display device according to Embodiment 4.
Figure 9A:
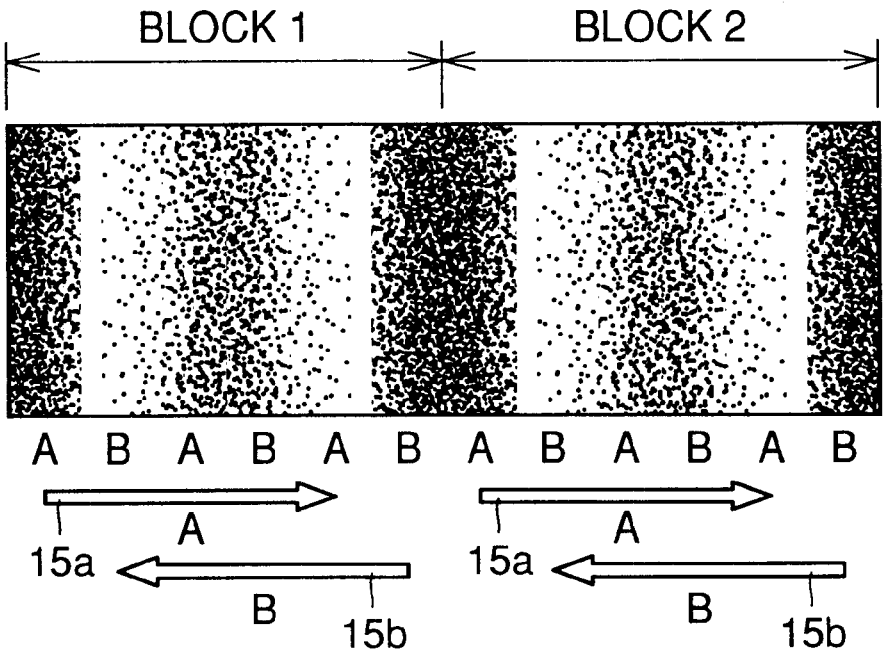
FIGS. 9A and 9B are illustrations showing unevenness in brightness on the display screen in Embodiment 4, where
Figure 9B:
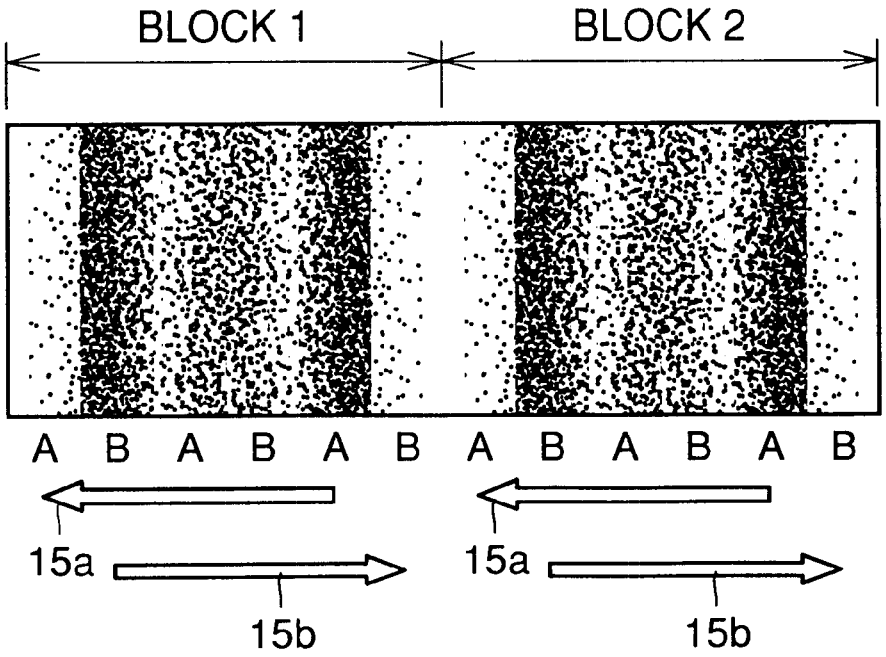

In this embodiment, a function of switching the driving direction is further added to Embodiment 3. Therefore, as shown in FIG. 8, the construction of the signal line driving circuit of the A-series or the B-series, for example, can be used as it appears in FIG. 2. Referring to FIGS. 9A and 9B, in this embodiment, uniformization of the unevenness in brightness in time is achieved between the frames in addition to the effect of the spatial intermixing of the unevenness in brightness described in the embodiment 3, so that the unevenness in brightness is less noticeable, thereby producing a good display quality.

Embodiment 5

Figure 10A:
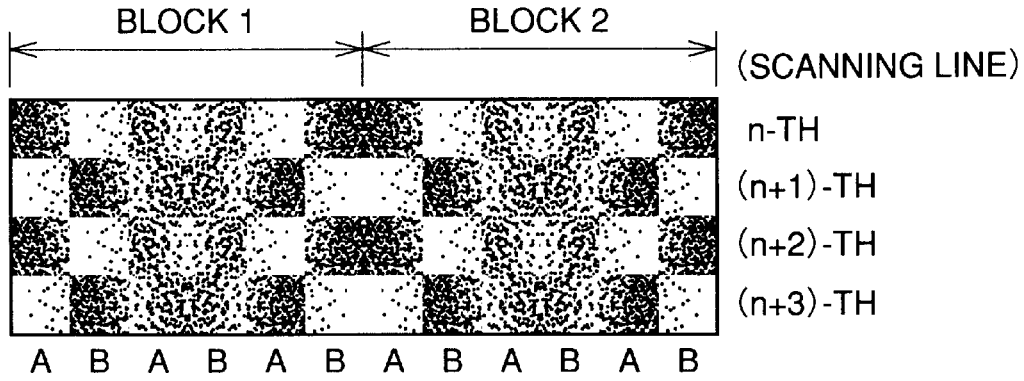
FIGS. 10A and 10B are illustrations showing unevenness in brightness on the display screen in Embodiment 5 in which the driving direction is switched for each scanning line, where
Figure 10B:
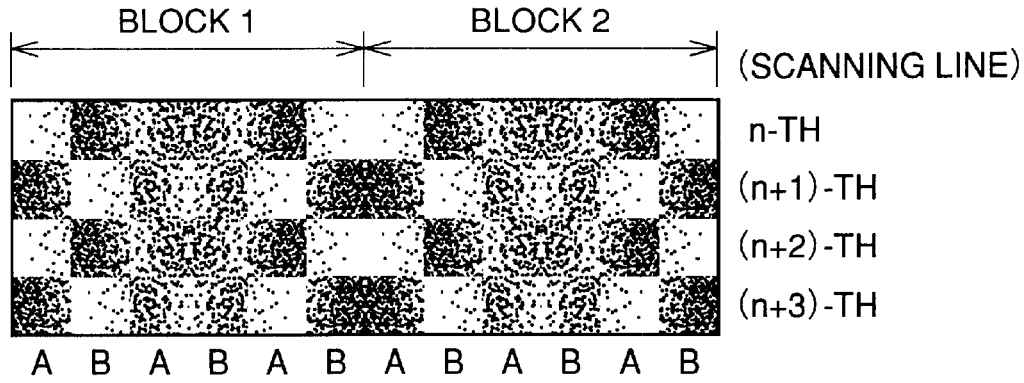
Figure 11:
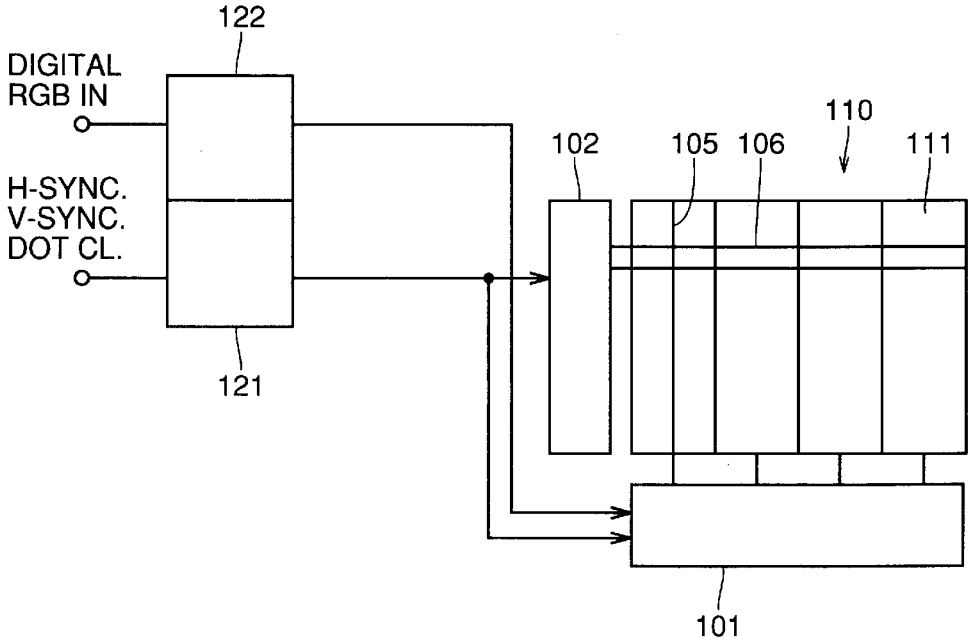
FIG.11 PRIOR ART
FIG. 11 is a schematic diagram representing a construction of a liquid crystal display device in a conventional example.
Figure 12:
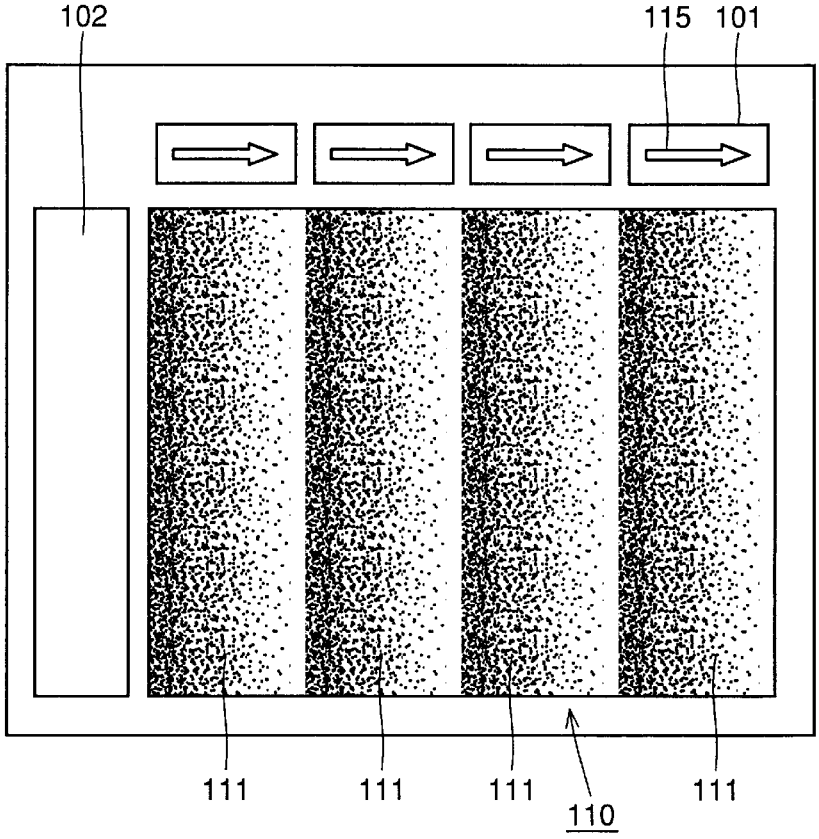
FIG.12 PRIOR ART
FIG. 12 is an illustration showing unevenness in brightness on the display screen in a conventional example.
Figure 13:
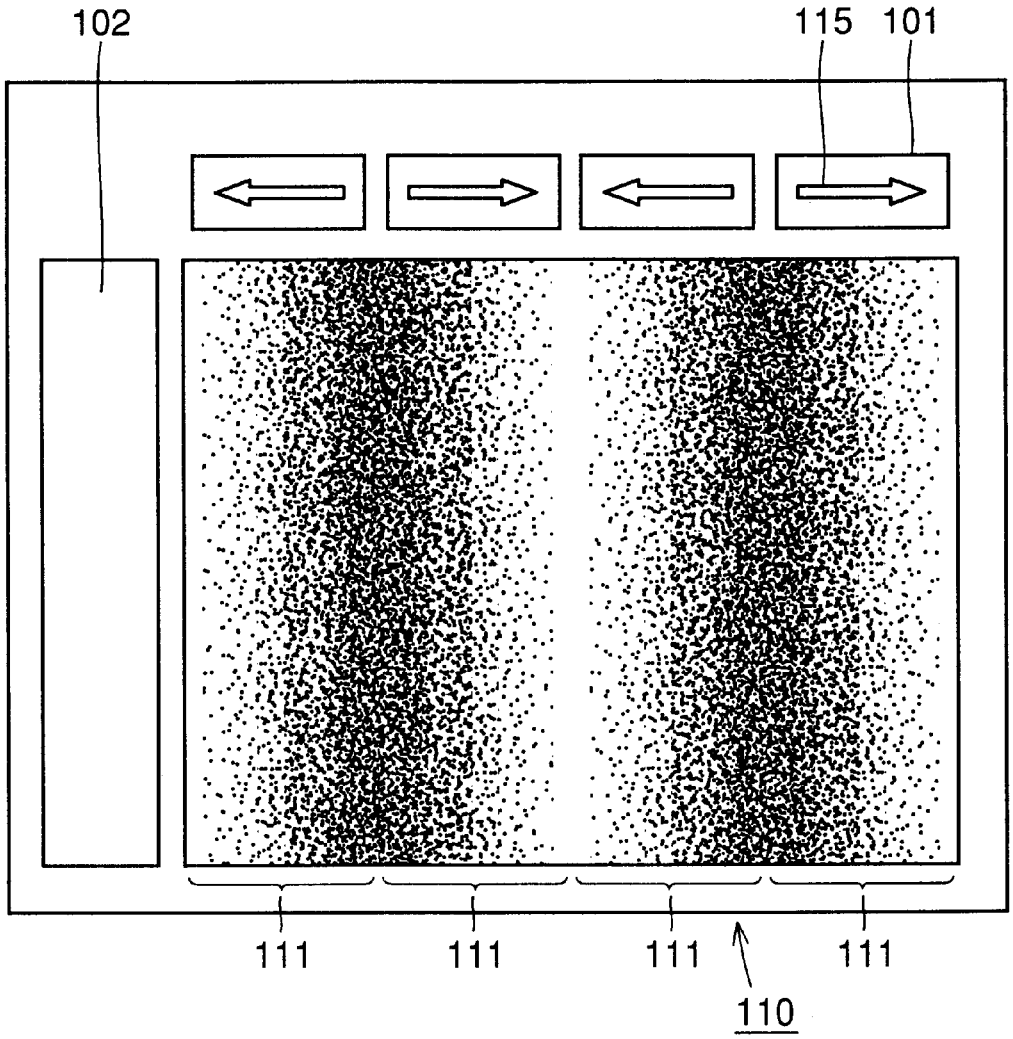
FIG. 13 PRIOR ART
FIG. 13 is an illustration showing unevenness in brightness on the display screen in another conventional example.

In Embodiment 5, unlike Embodiment 4 in which the driving direction is switched frame by frame, the driving direction is switched for each scanning line. Referring to FIGS. 10A and 10B, the unevenness in brightness is divided into smaller parts spatially by intermixing of the two series, i.e. the A-series and the B-series, and the intermixing of the unevenness in brightness by inversion of the driving direction for each scanning line. Further, the driving direction of each scanning line is inverted frame by frame, whereby the unevenness in brightness is made uniform in time. Further, because of the above-mentioned reasons, the flickering of the screen can be eliminated. As a result, the brightness appears to be extremely uniform to a human eye, making it possible to ensure a high display quality.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display device, comprising:

a signal processing circuit;

a timing circuit;

a plurality of scanning lines and a plurality of signal lines that cross each other in a display region that is divided into a plurality of blocks by boundaries parallel to the signal lines, each of said blocks containing a respective group of said signal lines;

liquid crystal display elements disposed where said scanning lines and said signal lines cross;

a signal line driving circuit that applies an image signal voltage, sent from said signal processing circuit and said timing circuit, to said signal lines of respective blocks, for point-sequential driving of said signal lines; and a scanning line driving circuit that applies a scanning signal voltage, sent from said timing circuit to said plurality of scanning lines, for driving the scanning lines, wherein said signal line driving circuit and said scanning line driving circuit are disposed in a driving circuit region;

said signal line driving circuit includes a driving direction switching circuit for inverting, upon passage of time, driving direction of point-sequential driving in respective blocks according to a signal from said signal processing circuit, each adjacent pair of blocks being driven in opposite driving directions from each other in the point-sequential driving;

said signal processing circuit includes an image signal rearranging circuit for rearranging image signals, in accordance with the inverting of the driving direction, in synchronization with the inverting of the driving direction;

said driving direction switching circuit includes a polarity inversion circuit for inverting polarity of the image signal voltage every time the driving direction of the point-sequential driving is inverted; and said timing circuit includes a driving direction switching timing output circuit for outputting switching timing for inverting the driving direction for each frame to said signal line driving circuit, wherein said signal processing circuit, said timing circuit, and said signal line driving circuit cooperatively rearrange time sequence order of the image signals so that an image on the display is not inverted.

2. A liquid crystal display device, comprising:

a signal processing circuit;

a timing circuit;

a plurality of scanning lines and a plurality of signal lines that cross each other in a display region that is divided into a plurality of blocks by boundaries parallel to the signal lines, each of said blocks containing a respective group of said signals lines;

liquid crystal display elements disposed where said scanning lines and said signal lines cross;

a signal line driving circuit that applies an image signal voltage, sent from said signal processing circuit and said timing circuit, to said signal lines of respective blocks, for point-sequential driving of the signal lines; and a scanning line driving circuit that applies a scanning signal voltage, sent from said timing circuit to said plurality of scanning lines, for driving the scanning lines, wherein said signal line driving circuit and said scanning line driving circuit are disposed in a driving circuit region;

the blocks each include a plurality of first sub-block groups and a plurality of second sub-block groups which are alternately disposed, and said signal line driving circuit includes a first group driving circuit for applying the image signal voltage to said liquid crystal display elements of the first sub-block groups for point-sequential driving, and a second group driving circuit for applying the image signal voltage to said liquid crystal display elements of the second sub-block groups for point-sequential driving, wherein said first group driving circuit and said second group driving circuit include a first group driving direction switching circuit and a second group driving direction switching circuit, respectively, for inverting the driving direction in the first sub-block groups and the second sub-block groups so the driving directions in the first sub-block groups and in the second sub-block groups are opposite to each other, and said signal processing circuit includes an image signal rearranging circuit for rearranging image signals in each sub-block group, in accordance with the inverting of the driving direction, in synchronization with the inverting of the driving direction.

3. The liquid crystal display device according to claim 2, wherein said timing circuit includes a driving direction switching timing output circuit for outputting switching timing for inverting the driving direction for each frame to said signal line driving circuit.

4. The liquid crystal display device according to claim 2, wherein said driving direction switching circuit includes a polarity inversion circuit for inverting polarity of the image signal voltage every time the driving direction of the point-sequential driving is inverted.

5. The liquid crystal display device according to claim 2, wherein said timing circuit includes a driving direction switching timing output circuit for outputting switching timing for inverting the driving direction for each scanning line to said signal line driving circuit.

* * * * *